US005222797A

United States Patent [19]

Holland

[11] Patent Number: 5,222,797

[45] Date of Patent: Jun. 29, 1993

[54] MULTI-CHAMBER CHEMILUMINESCENT OPTICAL DISPLAY DEVICE

[75] Inventor: Stanley Holland, Northridge, Calif.

[73] Assignee: Lexington & Associates, Northridge, Calif.

[21] Appl. No.: 785,654

[22] Filed: Oct. 31, 1991

[51] Int. Cl.[5] ..... F21K 2/06

[52] U.S. Cl. ..... 362/34; 362/84; 362/104; 362/171; 362/209; 362/216; 362/231; 362/806

[58] Field of Search ..... 362/34, 84, 171, 209, 362/216, 806, 231; 363/3; 252/700

[56] References Cited

U.S. PATENT DOCUMENTS

| | | | |
|---|---|---|---|
| 3,576,987 | 5/1971 | Voight | 362/34 |
| 3,764,796 | 10/1972 | Gilliam et al. | 362/34 |
| 3,781,536 | 12/1973 | Naeseth et al. | 362/34 |
| 3,875,602 | 7/1975 | Miron | 362/34 |
| 3,938,465 | 2/1976 | Lyons | 362/34 |
| 4,061,910 | 12/1977 | Rosenfeld | 362/104 |
| 4,864,475 | 9/1989 | Jung | 362/231 |
| 5,029,049 | 7/1991 | Ladyjensky | 362/34 |
| 5,158,349 | 10/1992 | Holland et al. | 362/34 |

*Primary Examiner*—Ira S. Lazarus
*Assistant Examiner*—L. Heyman
*Attorney, Agent, or Firm*—McHale & Slavin

[57] ABSTRACT

The instant invention teaches the use of conventional chemiluminescent constituents, admixed or separated, disposed within at least two juxtapose chambers in a parallel or helically woven pattern. The chamber each containing a distinct color that when viewed in placement of the instant invention, provides a combination color or rainbow type product that cannot be obtained by mixing dyes in a single chamber. The invention further providing a means for allowing new color combinations not available due to dye incompatibility.

13 Claims, 2 Drawing Sheets

MULTI-CHAMBER CHEMILUMINESCENT OPTICAL DISPLAY DEVICE

FIELD OF THE INVENTION

This invention relates generally to optical display devices, and, more particularly, to a multi-color spectral range display produced by a plurality of chemiluminescent devices interwoven or attached by use of formable housings.

BACKGROUND OF THE INVENTION

The use of optical chemiluminescent device to produce an artificial light is well known. A chemiluminescent device produces light based on a chemical reaction. U.S. Pat. No. 3,539,794 issued to Rauhut et al. Nov. 10, 1970 discloses a number of chemical compounds and their associated reactions which are typically used in production of chemiluminescent light. Conventionally, the production is based upon the reaction of a catalyzed hydrogen peroxide mixture (activator) with an oxalate such as bis(6-carbopentoxy-2,4,5-trichlorophenyl) oxalate "CPPO" and a dye in solvent, usually dibutyl phthalate. The activator component contained within a breakable ampule which, when broken, admixes with the oxalate to produce the chemiluminescent light. The activator and oxalate may be reversed.

A fluorescent or dye compound is required for light emission when an oxalic-type chemiluminescent compound is employed. Other compounds may not require a fluorescer but may use it to shift the wavelength of emitted light toward red region of the spectrum so as to change the color of the emitted light. If the activator and oxalate component are premixed, the reaction between the components can be inhibited or stopped by freezing the mixture.

A unique aspect of chemiluminescent light is that, in addition to the production of light, the chemical reaction generates negligible heat and can be used without danger of causing a fire or burning the consumer. This allows incorporation of the chemical into novelty items worn by humans. For example, a necklace can be formed by placing the chemical into a translucent tube or "light stick" and draping the light stick around an individuals neck, in a similar manner as a conventional necklace is worn. Further, the chemical can be used in situations where conventional electrical, battery, or solar powered light is inappropriate. The application may be as minute as a fishing lure or as diverse as a gaseous state known as an explosive environment.

Heretofore, the prior art presented a chemiluminescent light that generated light within a single spectral range. If an alternative color is desired, the conventional manner of obtaining the color is by variation of the dye. Thus, if a fisherman desired the use of a particular color fisherman was limited by the available oxalate dyes presented, however, some color combinations are not available due to dye incapability. Further, conventional practice is to keep the housing separate to prevent washout of the emitted light spectrum.

No one heretofore has addressed the need for a chemiluminescent light device that teaches the benefits of placing a plurality of colored chemiluminescent components in a parallel or interwoven fashion, allowing for the distinct characteristics of color blending from a distance. It is, therefore, to the effective resolution of this situation that the present invention is directed.

SUMMARY OF THE INVENTION

Generally, the instant invention relates to a multicolor spectral range display produced by a plurality of chemiluminescent housings or chambers placed in a close proximity. The invention comprises the use of a multiple strand chemiluminescent light device employing a plurality of elongated cylindrical-shaped formable housings made of flexible polyethylene or the like plastic. Each housing, or tube, defines an interior chamber where a chemiluminescent reactive mixture is placed. Each chamber having a distinct dye for effectuating various spectral wavelengths.

Accordingly, it is the primary object of the present invention to provide an aesthetically pleasing, simple, and reliable chemiluminescent light device capable of multiple color creation while transcending articulating surfaces for commercial, safety, and/or ornamental display purposes.

It is yet another object of the instant invention to provide a single housing having a plurality of chambers, either spatial spaced or interwoven, each chamber containing a reactive mixture of a predetermined color to effectuate a spectral color that is visually disparate when viewed from various positions.

Another object of the present invention is to provide an interwoven means of placing individual self-contained chemical lights which can be added or removed from a display.

Other objects and advantages of this invention will become apparent from the following description taken in conjunction with the accompanying drawings wherein set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

The invention may be better understood by reference to the drawings in which.

DETAILED DESCRIPTION OF THE INVENTION

As required, detailed embodiments of the present invention are disclosed herein, however, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Figure 1:
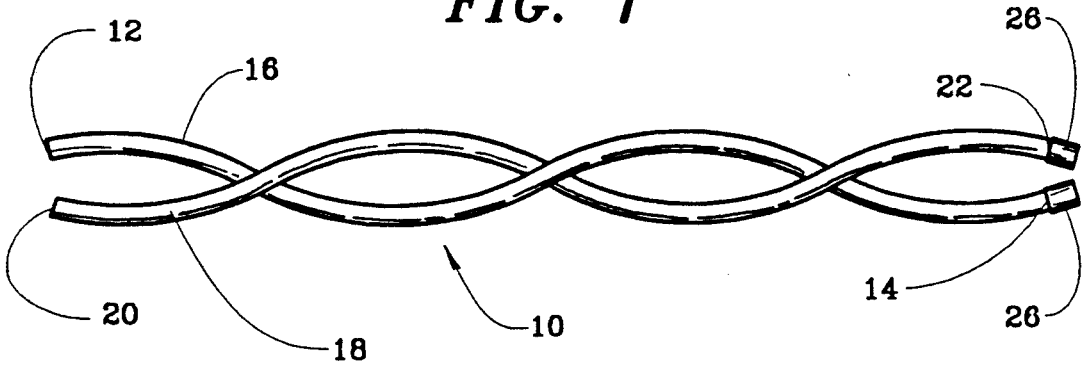
FIG. 1 is a prospective view of a double strand helically woven embodiment of the instant invention.

Referring to the drawings in more detail, FIG. 1 illustrates a multiple housing chemiluminescent light device 10 of the instant invention comprising a first elongated cylindrical-shaped formable housing 16 having a first end 12 and a second end 14. The preferred housing is made of flexible plastic, such as polyethylene, having properties that permit performed shape remembrance or, alternative, resiliency of original shape progression. The housing 10 can be termed a tube having an inner surface, not shown, defining an interior chamber therebetween. Within the interior chamber of housing 16 is placed a conventional chemiluminescent reactive mixture having a dye or fluorescer component creating a first spectral range wavelength.

Similarly a second elongated cylindrical-shaped formable housing 18 having a first end 20 and a second end 22 The housing 18 can be termed a tube having an inner surface, not shown, defining an interior chamber therebetween. Within the interior chamber of housing 18 is placed a conventional chemiluminescent reactive mixture having a dye or fluorescer component creating a second spectral range wavelength.

Housings 16 and 18 can be attached parallel, helically woven about a common axis, or planted together as illustrated in FIG. 1. Couplings 26 are used to join the first ends 12, 20 and second ends 14, 22 respectfully. Juxtapose placement of housings 16 and 18 create a optical sighting to the human eye in which the spectral range sensation depicts an alternative wavelength when viewed from a distance. For instance, placement of a red flourescer in oxalate of housing 16 and a blue flourescer in oxalate of housing 18 permits the eye to perceive the respective color wavelength as the reactive mixture reacts. However, when a distance is placed between the viewing angle and the combination, the result is the formation of a third colored wavelength that the eye perceives as a single color, in this example pink.

Figure 2:
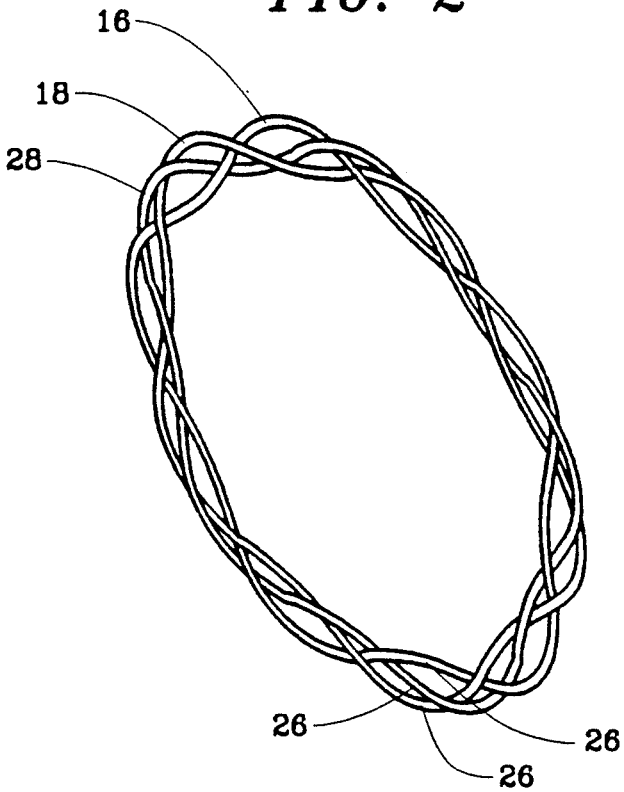
FIG. 2 is a prospective view of a triple strand helically woven embodiment of the instant invention formed into a novelty bracelet.
Figure 3:
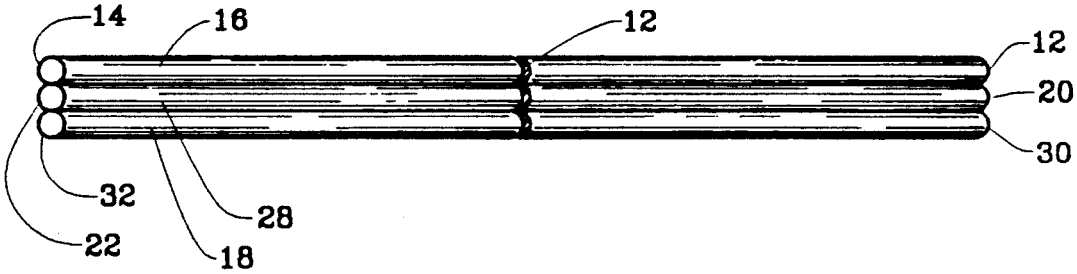
FIG. 3 is a side view of three strands placed in a parallel axis.
Figure 4:
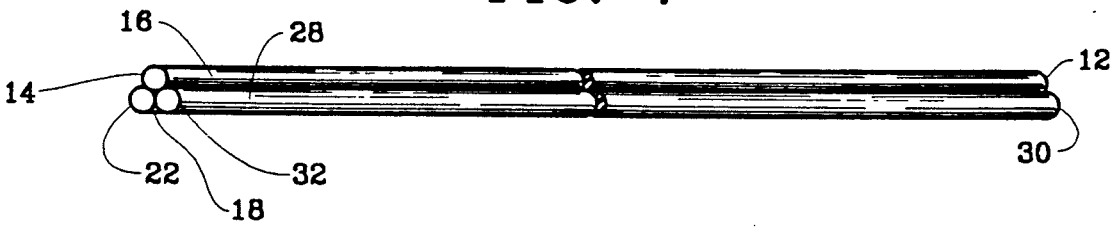
FIG. 4 is a side view of three strands placed in a triangular pattern.

Accordingly, additional strands or housings can be used providing further wavelength variation. For example, if a third strand 28 is employed as in FIGS. 2, 3 and 4, housings 16, 18, and 28 having a separate oxalate dye component, six spectral range wavelengths are possible when the housings are interwoven. A green, red and blue flourescer base will project such colors that when codified, may be viewed as yellow, pink, aqua, and violet, in addition to the base colors depending upon the viewing distance and angle. Ends 12, 20, and 30 can be coupled to ends 14, 22, and 32 respectfully by coupling means 26, either individually or collectively, forming a circular periphery such as a bracelet, necklace, or the like. Housings 16, 18, 28 can be interwoven as in FIG. 2, parallel as in FIG. 3, or pyramid as shown in FIG. 4.

When used against a single sided surface, a portion of the housings may include reflective characteristics or the like diffusive refraction characteristics incorporated therein such as a prismatic effect integral with said housing outer surface to further enhance the illumination qualities. Alternatively, the housing may be constructed of a colored translucent material.

Storage of admixed components requires freezing to inhibit or stop the chemiluminescent reaction, a procedure well known in the art. To activate, the frozen device is thawed causing reactivation of the chemiluminescent reaction.

Figure 5:
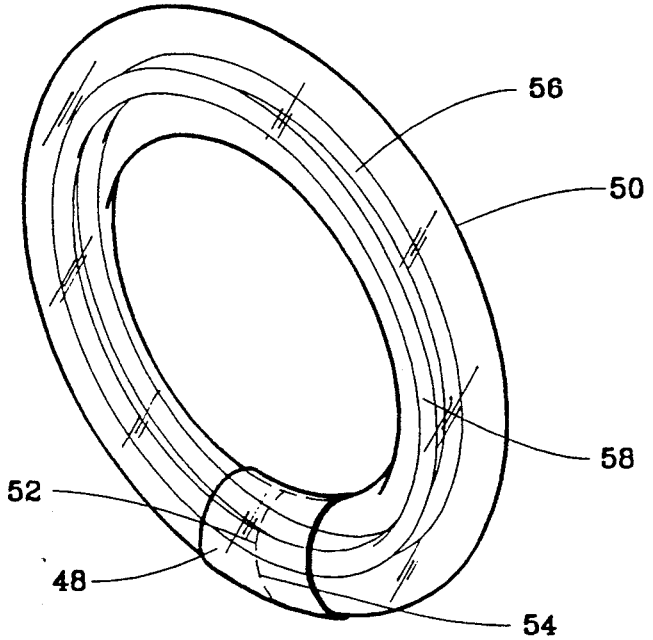
FIG. 5 is a perspective view of an alternate embodiment having a single housing with two chambers shaped in the form of a necklace.

Now referring to FIGS. 5, an alternative embodiment is illustrated wherein elongated cylindrical-shaped housing 50 having a first end 52 and a second end 54. First tubular-shaped chamber 56 and juxtaposed second tubular-shaped chamber 58 extends longitudinally along at least a portion of the housing 50 formed in a parallel plane along a common axis. A distinct reactive mixture disposed within each of said chambers. Alternatively, chambers 56 and 58 can be helically woven pattern about a common axis.

The device can further be set forth in as a process in which, (a) filling a plurality of formable housings, with a reactive mixture; (b) sealing the reactive mixture in said formable housings; (c) weaving at least two of said formable housings in a helically woven pattern about a common axis; (d) coupling the first end of said formable housing to the second end forming a substantially circular periphery; (e) freezing said formable housings thereby inhibiting activation of said reactive mixture; (f) thawing said formable housings for activation of said reactive mixture thereby creating a chemiluminescent light.

Figure 6:
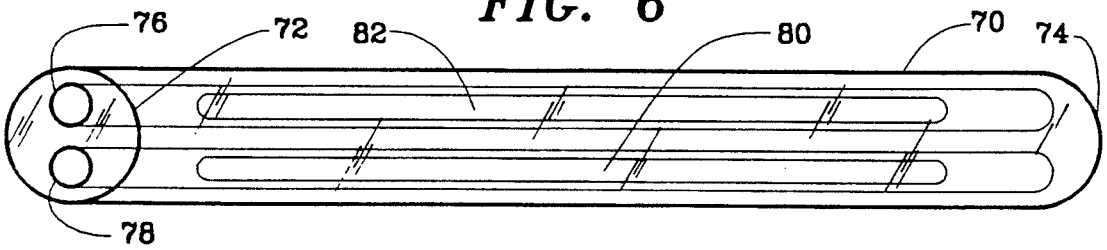
FIG. 6 is a perspective view of an alternative embodiment having a single housing with two chambers incorporating a separate oxalate or activator placed within a breakable ampule within the chamber.

FIG. 6 illustrates an alternative embodiment using ampules wherein elongated cylindrical-shaped housing 70 having a first end 72 and a second end 74. First tubular-shaped chamber 76 and juxtaposed second tubular-shaped chamber 78 extends longitudinally along at least a portion of the housing 70 formed in a parallel plane along a common axis. Rigid elongated tubes or ampules 80 and 82 having a activator disposed therein is slidably insertable in interior chamber 76 and 78. At least one oxalate component is disposed within interior chambers 76 and 78 between the outer surface of the rigid tube and the inner surface of said chambers. It should be noted that the ampule 80 and 82 may contain the oxalate and the respective chambers 76 and 78 contain the activator. Alternatively, the housing 70 can be one of a number of housings helically woven about a common axis or planted together to form a braided structure.

To activate the inventive devices, the rigid tube is broken, usually by flexing the device, thereby causing the oxalate and activator components to admix which brings about the chemiluminescent reaction.

The device can further be set forth in as a process in which, (a) filling a plurality of chambers made from a formable housing, said chamber sealed at a first end and opened at a second end, with a oxalate; (b) inserting an ampule filled with an activator is each of said chambers; (c) sealing the ampule and activator in said chamber; (d) breaking said ampule to activate the oxalate thereby creating a chemiluminescent light.

Step (a) and (b) can be reversed having the oxalate within the ampule and the activator in the chamber. Each chamber can be made to house a different color.

Figure 7:
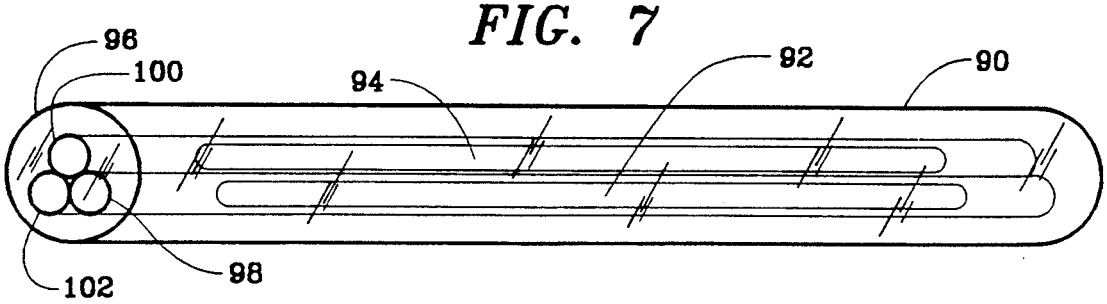
FIG. 7 is a perspective view of an alternative embodiment having a single housing with three chambers incorporating a separate oxalate or activator placed within a breakable ampule within the chamber.

FIG. 7 illustrates an alternative embodiment using ampules wherein elongated cylindrical-shaped housing 90 having three chambers with ampules 92, 94 and 96—not shown, disposed within chambers 98, 100, and 102 respectfully. Tubular-shaped chamber 98, 100, and 102 extend longitudinally along at least a portion of the housing 90 formed in a parallel plane along a common axis. The ampules having an activator disposed therein is slidably insertable in the chamber with at least one oxalate component further disposed within each of said chambers placed between the outer surface of each ampule and the inner surface of the chamber wall. It should be noted that the ampules 98, 100, and 102 may contain the oxalate and the respective chambers contain the activator. Alternatively, the housing 90 can be one of a number of housings helically woven about a common axis or planted together to form a braided structure.

To activate the inventive device, the ampules are broken, usually by flexing the housing 90, thereby causing the oxalate and activator components to admix which brings about the chemiluminescent reaction.

It is to be understood that while we have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What I claim as new and desire to secure by Letters Patent of the United States is:

1. A multi-color chemiluminescent light device comprising: a plurality of hollow elongated formable housing, each of said housings having a first end and a second end defining an interior chamber therebetween; a premixed chemiluminescent reactive mixture whose light intensity is inhibitable by freezing disposed within said interior chamber of each of said formable housing; said formable housings being juxtaposed in a predetermined position to permit mixing of wavelengths produced by each said chemiluminescent reactive mixture; and a means for coupling together the first end and the second end of each of said housings;

whereby one of said housing contains a first reactive mixture capable of producing a first visual wavelength and at least one of said housings contains a second reactive mixture capable of producing a second visual wavelength, wherein said predetermined position provides a wavelength of distinct visual color ascertainable by the human eye when said chemiluminescent reactive mixture is in an unfrozen condition, said distinct visual color is simultaneous and in addition to the chemiluminescently produced colors from each said reactive mixture.

2. The chemiluminescent light device according to claim 1, wherein said predetermined position is obtained by placing said housings in a helically woven pattern.

3. The chemiluminescent light device according to claim 1, wherein said housings are constructed of a clear translucent material.

4. The chemiluminescent light device according to claim 1, wherein said housing are constructed of a colored translucent material.

5. The chemiluminescent light device according to claim 1, wherein said reactive mixture comprises at least one oxalate component and at least one activator component.

6. The chemiluminescent light device according to claim 1, wherein said predetermined position is obtained by placing said housings a fixed spacial distance from each other along a portion of the longitudinal length thereof.

7. The chemiluminescent light device according to claim 1, wherein said reactive mixture placed in each of said chambers contains a dye distinct from an adjoining chamber.

8. A multi-color chemiluminescent light device comprising: an elongated flexible housing having a first end and a second end and at least two hollow chambers extending longitudinally along at least a portion of said housing; a premixed chemiluminescent reactive mixture whose light intensity is inhibitable by freezing disposed within each of said chambers; each said chamber placed in a predetermined position to permit mixing of wavelengths produced by each said chemiluminescent reactive mixture; and a means for coupling the first end to the second end of said housing;

whereby one of said chambers contains a first reactive mixture capable of producing a first visual wavelength and at least one additional chamber contains a second reactive mixture capable of producing a second visual wavelength, wherein placement of each said chamber in a predetermined position provides a wavelength of distinct visual color ascertainable by the human eye when said chemiluminescent reactive mixture is in an unfrozen condition, said distinct visual color is simultaneous and in addition to the chemiluminescently produced colors from each said reactive mixture.

9. The chemiluminescent light device according to claim 6, wherein said chambers are formed in a helically woven pattern about a common axis.

10. The chemiluminescent light device according to claim 6, wherein said reactive mixture comprises at least one oxalate component and at least one activator component.

11. The chemiluminescent light device according to claim 6, wherein said reactive mixture placed in each of said chambers contains a dye distinct from an adjoining chamber.

12. A process for creating a multi-color chemiluminescent light comprising the steps of:

(a) filling a first formable housing having a first end and a second end with a premixed chemiluminescent reactive mixture capable of producing light at temperatures above freezing;

(b) sealing the reactive mixture in said first formable housing;

(c) filling at least one additional formable housing with premixed chemiluminescent reactive mixture capable of producing light of a disparate color to said first housing at temperatures above freezing;

(d) sealing the reactive mixture in said second formable housing;

(e) juxtapositioning said housings in a predetermined position to provide a mixing of chemiluminescent wavelengths thereby providing a distinct visual color ascertainable by the human eye;

(f) attaching a means for coupling said first end to said second end on said first end;

(h) freezing said formable housings thereby inhibiting chemiluminescent light intensity of said reactive mixture for storage;

(i) thawing said formable housings to restore chemiluminescent light intensity of said reactive mixture whereby each reactive mixture produces a chemiluminescent light and the juxtapositioning of said housings mixes chemiluminescent wavelengths to produce said distinct visual color simultaneous and in addition to the chemiluminescently produced colors from each said reactive mixture.

13. A process for creating a multi-color chemiluminescent light comprising the steps of:

(a) sealing a first end of a flexible transparent housing containing at least two hollow chambers arranged in a predetermined position;

(b) filling each said chamber of said housing with a premixed chemiluminescent reactive mixture capable of producing light at temperatures above freezing, each said chamber containing a disparate color of said chemiluminescent reactive mixture;

(c) sealing a second end of said housing sealing said reactive mixtures in said chambers;

(d) attaching a means for coupling said first end to said second end on said first end;

(f) freezing said housing thereby inhibiting chemiluminescent light intensity of said reactive mixture for storage;

(g) thawing said formable housing to restore chemiluminescent light intensity of said reactive mixture whereby each reactive mixture produces a chemiluminescent light wherein the arrangement of said chambers allows mixing of chemiluminescent wavelengths to produce a distinct visual color simultaneous and in addition to the chemiluminescently produced colors from each said reactive mixture.

* * * * *